United States Patent [19]

Brandon

[11] Patent Number: 4,918,839

[45] Date of Patent: Apr. 24, 1990

[54] SANITARY SHOE COVER

[75] Inventor: Bobby C. Brandon, Columbus, Miss.

[73] Assignee: Teknamed Corporation, Columbus, Miss.

[21] Appl. No.: 274,487

[22] Filed: Nov. 22, 1988

[51] Int. Cl.[5] ..... A43B 3/16

[52] U.S. Cl. ..... 36/7.1 R; 36/97; D2/272

[58] Field of Search ..... 36/7.1 R, 7.2, 7.3, 36/7.5, 7.6, 7.7, 72 R, 97; D2/271, 272, 275

[56] References Cited

U.S. PATENT DOCUMENTS

| | | | |
|---|---|---|---|
| D. 117,168 | 10/1939 | Donovan | D2/272 |
| D. 147,499 | 9/1947 | Gibbs et al. | D47/7 |
| D. 193,652 | 9/1962 | Adams | D7/7 |
| D. 209,036 | 10/1967 | Zimmon | D2/271 |
| D. 256,516 | 8/1980 | Michalak | D2/271 |
| D. 267,365 | 12/1982 | Hansen | D2/275 |
| D. 267,832 | 2/1983 | Pask | D2/271 |
| D. 290,303 | 6/1987 | Womack | D2/272 |
| 1,717,690 | 6/1929 | Ihnen | 36/7.1 R |
| 2,229,575 | 1/1941 | Kaplan | D2/271 |
| 2,449,936 | 9/1948 | Glasgow | D2/271 |
| 2,494,701 | 1/1950 | Gogerty | 36/81 |
| 2,669,035 | 2/1954 | Marx | 36/7.3 |
| 2,745,196 | 5/1956 | Schneider | 36/97 |
| 2,924,029 | 2/1960 | Rosen | 36/7.1 |
| 2,958,012 | 10/1960 | Melman | 36/7.1 R |
| 2,973,589 | 3/1961 | Rigsby | 36/97 |
| 3,034,231 | 5/1962 | Schwartz | 36/7.2 |
| 3,106,790 | 10/1963 | Zimmon | 36/9 R |
| 3,146,377 | 8/1964 | Whitton, Jr. | D2/275 |
| 3,296,489 | 1/1967 | Ceraldi | 361/223 |
| 3,324,580 | 6/1967 | Baxter | 36/8.1 |
| 3,335,506 | 8/1967 | Peace | D2/272 |
| 3,337,770 | 8/1967 | Saraceni et al. | 317/2 |
| 3,358,188 | 12/1967 | Zimmon | 36/7.1 R |
| 3,359,658 | 12/1967 | Price | 36/7.1 R |
| 3,422,550 | 1/1969 | Robinson | 36/7.1 R |
| 3,497,875 | 3/1970 | Rivera | 36/7.2 |
| 3,605,291 | 9/1971 | Moore et al. | 36/7.1 R |
| 3,648,109 | 3/1972 | Tims et al. | 317/2 |
| 3,735,758 | 5/1973 | Novotney | 128/82 |
| 3,735,759 | 5/1973 | MacKay | 36/7.2 |
| 3,798,503 | 3/1974 | Larsh et al. | 317/2 B |
| 3,801,868 | 4/1974 | Bryant | 317/2 B |
| 3,824,714 | 7/1974 | Glassman | 36/7.1 R |
| 4,019,265 | 4/1977 | Epstein | 36/7.1 R |
| 4,178,703 | 12/1979 | Pols | 36/110 |
| 4,301,603 | 11/1981 | Scott | 36/110 |
| 4,598,485 | 7/1986 | Joe et al. | 36/7.2 |
| 4,616,429 | 10/1986 | Alcala | 36/7.2 |
| 4,825,564 | 5/1989 | Sorce | 36/7.1 R |

FOREIGN PATENT DOCUMENTS

| | | | |
|---|---|---|---|
| 3630738 | 3/1988 | Fed. Rep. of Germany | 36/7.1 R |
| 3636378 | 4/1988 | Fed. Rep. of Germany | 36/7.1 R |
| 999575 | 2/1952 | France | 36/7.2 |
| 1889 | 5/1915 | United Kingdom | 36/7.3 |
| 941098 | 11/1963 | United Kingdom | 36/7.3 |

OTHER PUBLICATIONS

Miles Kimball, 1955 catalog-item D-3923.
Miles Kimball, 1968 (Fall) catalog-items 0150, 0151.
Amercian Hospital Supply, 1974 catalog #150, pp. 389, 390.
Dillon Mfg. Co., (Bunny Line), 1974 Catalog, p. 22.
VWR Scientific, 1980 catalog #80, p. 1074.

*Primary Examiner*—Werner H. Schroeder
*Assistant Examiner*—Diana L. Biefeld
*Attorney, Agent, or Firm*—Oblon, Spivak, McClelland, Maier & Neustadt

[57] ABSTRACT

A shoe cover which includes a pair of substantially flat textured strips of material secured together along peripheral edges thereof for forming a substantially straight edged bottom portion, a deformable heel portion, a toe portion, an instep portion, and having an opening formed at an upper portion thereof, at least one securing strip being connected to said heel portion and which includes a mechanism for selectively adjusting a length dimension of the bottom portion and for securing said flat sheets of material to a shoe.

5 Claims, 2 Drawing Sheets

SANITARY SHOE COVER

BACKGROUND OF THE INVENTION

1. Field of the Invention:

The present invention is directed to a bootlike shoe cover designed for an infection control area or similar environment which serves to prevent water or other fluids from penetrating the shoe cover.

2. Discussion of the Background:

Shoe covers for surgery and similar procedures have been proposed which may, for example, be worn by hospital personnel in a surgical setting, or by a patient over the end of a leg cast to protect it from wetness, dust, dirt, etc. Additionally, or alternatively, coverings to protect footwear from rain, snow, mud and the like are known. Such are characterized by the drawback that covers for different size shoes of the wearer require a complex pattern and are different size covers, thus requiring a larger inventory to fit all potential wearers. Such covers also oftentimes have a slick bottom which makes for unsure footing on wet surfaces. It is therefore understood that there is a need for a shoe cover which is simple in design and yet both allows for a quick and easy adjustability of the length of the boot so as to fit all individuals which can be securely attached to the shoe and lower leg portion of the wearer and which provides for sure footing for the wearer.

SUMMARY OF THE INVENTION

It is therefore an object of the present invention to provide a shoe cover or bootee which allows for an adjustment of the length of the shoe covering for the purpose of adequately fitting all individuals, which allows for securing of the upper portion of shoe cover to the lower leg portion of the wearer and securing of the shoe covering to the shoe or other foot covering of the individual.

It is a further object of the present invention to be utilized in an infection control area or similar environment and which will keep water and other fluids spilled during surgical procedure from dripping down the leg of, for example, a doctor and entering the shoe via the shoe laces.

The shoe cover also is characterized by being provided with a grip-type bottom to keep the wearer from slipping or falling in a wet or slick environment.

A further object of the present invention is to provide a shoe cover which includes a pair of substantially flat sheets of material secured together along peripheral edges thereof and forming a straight edged bottom portion, a deformable heel portion, a toe portion, an instep portion and having an opening formed at an upper portion thereof, at least one tie strip secured to the heel portion which includes a mechanism for selectively adjusting a length dimension of the bottom portion and for securing the flat sheets of material to a shoe or other footwear.

A further object of the invention is to provide a shoe covering wherein the heel portion includes a rear corner portion of the flat sheets of material, wherein the at least one tie strip includes a first and second tie strip and wherein a mechanism for securing the flat sheets includes means for securing end portions of the first and second tie strip to one another adjacent an instep portion of the shoe covering.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
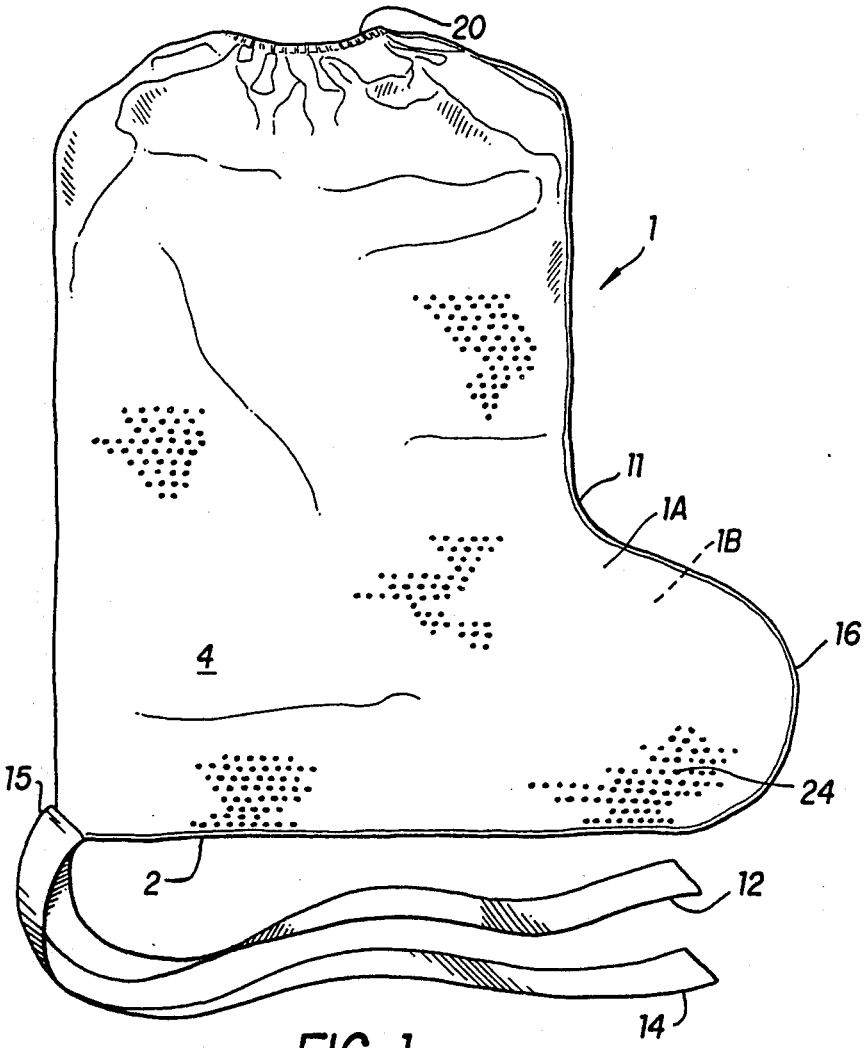
FIG. 1 shows a perspective view of a shoe cover in accordance with the present invention including the details of the recesses of the shoe cover forming a pattern on the surface thereof.
Figure 2:
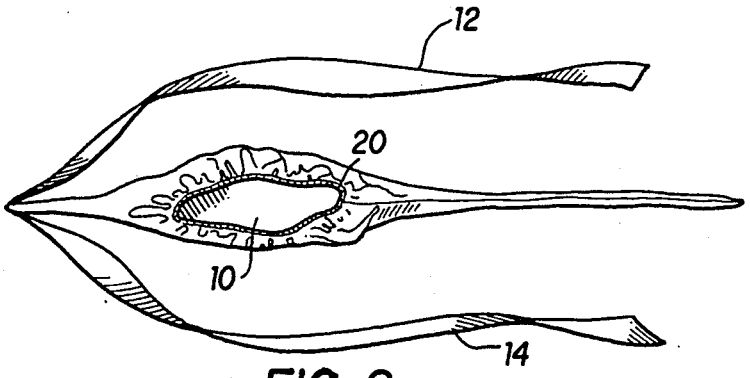
FIG. 2 shows a plan view of the shoe cover of FIG. 1.

As shown in FIGS. 1 and 2, the shoe cover in accordance with the present invention comprises a bootee which includes a pair of substantially flat strips 1A, 1B made from a polyethylene sheet which is textured by running the sheet over a heated calendar roll that has formed on the surface thereof a design that creates the texture on the plastic sheet. The pair of strips 1A, 1B are connected by a sealing process along their peripheral or front, bottom and rear edges. Reference numeral 2 denotes a straight edged seam or bottom edge member of the bootee 1. The texture on the bottom portion of the shoe cover serves as a grip cover to keep the user, such as a doctor, nurse or medical assistance, from slipping or falling in a wet or slick environment.

A thin double-walled plastic sheet is therefore formed by the securing together of flat strips 1A, 1B, the sheet or bag 4 thus formed extending upward from the bottom edge member 2 to a point well above the ankle 6 of the wearer's leg 8 so as to form a shoe cover.

A circular opening 10 is formed at the upper portion of the bootee 1 and includes an elastic band for sealing the wearer's leg from intrusion by fluids. The upwardly rearward slanted instep portion 11 of the bootee 1 is dimensioned so as to conform to the shoe or other footwear of the wearer.

The bootee 1 has secured thereto first and second plastic tie strips 12, 14 attached at a first end thereof by sewing, adhesion or in a similar manner to the bottom corner or heel portion 15 of the bootee. An opposite end of each of the first and second plastic tie strips 12, 14 extend towards instep edge portion 11 for being tied thereagainst and thus secures the bootee to the shoe or other footwear of the wearer. Reference numeral 16 denotes that the toe portion of the bootee which, when slipped over the shoe of the wearer and tied, is positioned directly adjacent the toe portion 16 of the shoe.

Indicated by reference numeral 20 is a strip of elastic material secured along the circumference of the openings 10 of the bootee to conform to the size of the leg of the wearer. Indicated by reference numeral 22 is the tied portion of the flat strips 12, 20.

Figure 3:
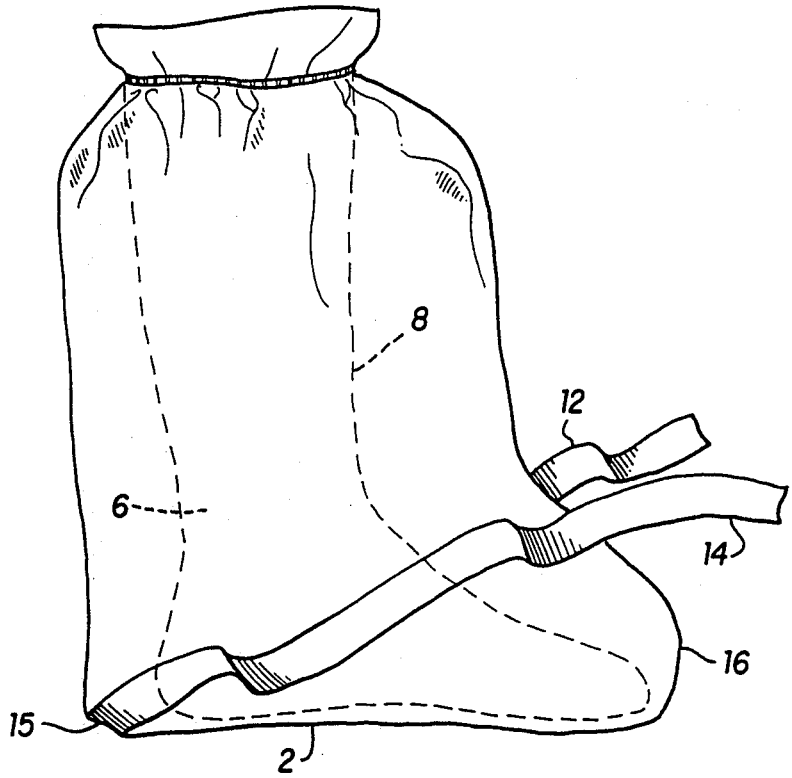
FIG. 3 shows the manner in which the shoe cover is secured to the shoe of the user.
Figure 4:
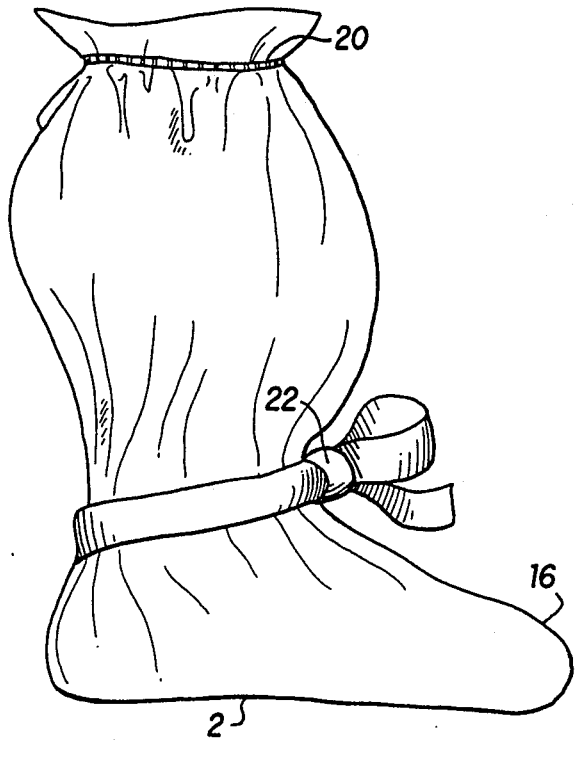
FIG. 4 illustrates the manner in which the shoe cover is secured to the leg and shoe of the user.

In use, the bootee 1 is held at the top portion thereof by the right and left hand of the user and the opening 10 is widened for insertion of the shoe or other footwear of the wearer. The bootee 1 is slipped over the shoe until the toe portion 16 firmly engages the toe portion or toe of the individual's shoe or foot. The bootee 1 is then held in position by the elastic material 20 of the opening 10 so as to allow the user to grasp with opposite hands the first and second plastic tie strips 12 14 shown in FIG. 3 and to pull the same forward and upward so as to allow the toe and bottom portion of the shoe to engage the toe and bottom edge of the shoe cover and to allow for an adjustment of the length of the bootee so as to correspond to that of the shape of shoe of the wearer, followed by securing the tie strips 12, 14 by forming the tied portion 22 shown in FIG. 4.

FIG. 1 shows the details of a plurality of recesses 24 formed on at least a lower portion of each of the substantially flat strips 1A, 1B for improved footing or skid resistance slipping floors.

It can thus be appreciated that the shoe covering in accordance with the present invention allows the same to be loosely fitted over a regular shoe. The shoe cover or bootee will normally be larger than the shoe that it covers and will slip back and forth on the foot when loosely fitted thereon. By use of the tie strips secured to the heel and brought across the instep on front of the foot normally where the shoelaces are tied, such serves to securely hold the shoe cover on and, due to the adjustability of the length of the cover, forms a very comfortable shoe cover.

The present invention is also characterized by a minimal number of parts necessary to be manufactured to form the shoe cover in accordance with the present invention.

Obviously, numerous modifications and variations of the present invention are possible in light of the above teachings. It is therefore to be understood that within the scope of the appended claims, the invention may be practiced otherwise than as specifically described herein.

What is new and desired to be secured by Letters Patent of the United States is:

1. A shoe cover, comprising:

a pair of substantially flat sheets of material secured together along peripheral edges thereof and forming a substantially straight edged bottom portion, a deformable heel portion, a toe portion, an instep portion and having an opening formed at an upper portion of the flat sheets;

at least one securing strip means secured to said heel portion and securable around said instep portion for selectively adjusting a length dimension of said bottom portion and for securing said flat sheets of material to a shoe wherein said heel portion comprises a rear corner portion of said flat sheets of material.

2. A shoe covering as set forth in claim 1, wherein said at least one securing strip means comprises a first and second tie strip and which comprises means for securing end portions of said first and second tie strip to one another adjacent said instep portion.

3. A shoe covering as set forth in claim 1, which comprises elastic means secured along a circumferential portion of said opening for conforming said opening to a wearer's leg.

4. A shoe covering as set forth in claim 1, wherein said material of said flat sheets comprises polyethylene having a textured surface.

5. A method for covering a shoe with a shoe cover having a pair of substantially flat sheets of material secured together along peripheral edges thereof and forming a substantially straight edged bottom portion including a deformable heel portion, a toe portion, an instep portion and including an opening formed at an upper portion of the flat sheets and at least one securing strip connected to said heel portion which comprises:

inserting said shoe into said opening and contacting said toe and bottom portion with said shoe;

deforming said heel portion by pulling on said at least one securing strip for adjusting a length dimension of said bottom portion and said heel portion engaging a heel portion of said shoe; and securing said flat sheets to an instep portion of said shoe via said at least one securing strip.

* * * * *